US005742131A

United States Patent [19]

Sprout et al.

[11] Patent Number: 5,742,131

[45] Date of Patent: Apr. 21, 1998

[54] DIMMABLE BALLAST CONTROL CIRCUIT

[75] Inventors: James C. Sprout, Los Altos; Jerome M. Mix, Redwood City, both of Calif.

[73] Assignee: The Watt Stopper, Santa Clara, Calif.

[21] Appl. No.: 370,949

[22] Filed: Jan. 10, 1995

Related U.S. Application Data

[63] Continuation-in-part of Ser. No. 156,492, Nov. 23, 1993, Pat. No. 5,402,040.

[51] Int. Cl.[6] ..... H05B 37/02

[52] U.S. Cl. ..... 315/157; 315/291; 315/158; 315/149; 315/DIG. 4

[58] Field of Search ..... 315/159, 156, 315/157, 158, 149, 291, DIG. 4

[56] References Cited

U.S. PATENT DOCUMENTS

| | | | |
|---|---|---|---|
| 4,135,116 | 1/1979 | Smith | 315/158 |
| 4,449,074 | 5/1984 | Luchaco | 315/159 |
| 5,130,613 | 7/1992 | Szuba | 315/291 |
| 5,220,250 | 6/1993 | Szuba | 315/307 |
| 5,357,170 | 10/1994 | Luchaco et al. | 315/159 |
| 5,402,040 | 3/1995 | Sprout | 315/157 |
| 5,406,173 | 4/1995 | Mix et al. | 315/156 |

*Primary Examiner*—Robert Pascal
*Assistant Examiner*—Arnold Kinkead
*Attorney, Agent, or Firm*—Townsend and Townsend and Crew LLP

[57] ABSTRACT

A control circuit for controlling the light output level of a dimmable fluorescent light ballast such as the Mark VII ballast manufactured by Advance Transformer, Inc. The circuit operates from power supplied by the Mark VII ballast through a 300 to 500 microamp DC current loop. The control circuit includes a photo sensor that detects the level of ambient light in a room, and in response to the detected light level, the circuit sets a voltage level from 2 and 10 volts between the two output leads for the current loop on the ballast. At 2 volts, the light is at its dimmest level, which is 20 percent of its maximum brightness, while at 10 volts, the light is at the 100 percent level. Between 2 and 10 volts, the light's brightness is set on a linear scale between 20 and 100 percent.

10 Claims, 4 Drawing Sheets

DIMMABLE BALLAST CONTROL CIRCUIT

CROSS-REFERENCE TO RELATED APPLICATION

This application is a continuation-in-part of U.S. Ser. No. 08/156,492, filed Nov. 23, 1993, now U.S. Pat. No. 5,402,040.

BACKGROUND OF THE INVENTION

The present invention relates to a circuit that controls the brightness of a light. More specifically, the present invention pertains to a circuit that controls the brightness of a light connected to a dimmable electronic ballast such as the Mark VII Fluorescent Lamp Ballast manufactured by Advance Transformer Company.

The Mark VII Fluorescent Lamp Ballast provides a pair of output leads through which it supplies a DC current loop of between 300 and 500 microamps. To control the intensity level of a light connected to the Mark VII ballast, the voltage level between these two leads is adjusted between 2 and 10 volts. At 2 volts, the light connected to the ballast is at its minimum output of 20 percent. While at 10 volts, the light is operating at the 100 percent level.

The 2–10 volt operating range has become somewhat of a standard in the lighting industry. Other manufacturers, such as Motorola, provide dimmable fluorescent lamp ballasts that adjust the intensity level of a light using the same 2–10 volt operating range.

It is desirable to control the brightness of lights connected to the ballasts such as the Mark VII (hereinafter "ballast(s)" is used to refer to the group of dimmable ballasts) in response to the level of ambient light in an area or room. When the ambient light level is low, the lights can be operated at their 100 percent output level to provide maximum lighting for the room, and when the ambient light level is high, the ballast can dim the output of the lights to save electricity.

A known prior art circuit manufactured by Multipoint Lighting Control Systems controls the brightness of lights connected to ballasts such as the Mark VII using a reversed-biased photo sensor to detect the ambient light level in a room. Reverse-biasing a photo sensor, however, results in a nonlinear response to the detected light level. Thus, the Multipoint circuit cannot control the ballasts in a manner such that a constant light level is accurately maintained in a room.

Additionally, in determining the brightness level of the light connected to the ballast, the Multipoint circuit compares the output of the photo detector after it has been amplified by a transistor to a reference voltage created by the voltage drop across a base and emitter of a transistor that can vary significantly with the temperature. Using an unstable voltage as a reference voltage also detracts from the control circuit's ability to accurately maintain a constant light level in a room.

The Multipoint circuit also does not distinguish between occasions when it decreases the brightness of a light versus occasions when it increases the brightness of a light. Making such a distinction allows the light level in a room to be constantly maintained at an appropriately bright level while minimizing distractions to inhabitants of a room because the brightness of the lights is constantly being adjusted. For example, on a sunny day with numerous clouds, the ambient light level will constantly be changing depending on when the sun is blocked by a cloud. On such days, it is important to set the sensitivity of the light controller such that lights are not continuously dimmed and brightened, and it is important to maintain the brightness of the lights so that vision is not impaired. It is also important, however, to save electricity and decrease the light level when the sun is out for a sufficiently long period. In light of these conflicting demands on the light controller, it is desirable to control the lights such that their brightness is decreased at a first rate of change and it is increased at a second rate of change that is faster than the first rate.

In controlling lights connected to these ballasts, it is also desirable to allow a user select a desired brightness level of the light. The ballast control circuit can then adjust the light's intensity level to the selected brightness. Any variable resistance type switch or pot can be used to allow the user to select a particular brightness level.

For a user to easily decide upon a selected brightness level, the lights should be responsive to the control switch without the added delay the control circuit adds to brightness adjustment during the automatic mode. Thus, it is desirable for a such light level controller to have a brightness level control switch that overrides the automatic delay.

SUMMARY OF THE INVENTION

One embodiment of the present invention provides a control circuit for electronic ballasts such as the Mark VII ballast that can accurately increase and decrease the brightness of lights in response to a detected level of ambient light to maintain a constant light level in a room. The control circuit derives power from the 300 to 500 microamp DC current loop supplied by the ballast's two output leads.

The circuit includes a zero-biased photo sensor that detects the level of ambient light in a room and can provide a linear output response to the detected light level, a reference diode that sets a precision reference voltage level so that the control of the ballast is independent of temperature, a pair of operational amplifiers that amplify the detected light level and compare it to the reference voltage level, respectively, transistor means that limits the current pulled through the operational amplifier and amplifies the difference in the light level and reference level voltages allowing up to 100 ballasts to be controlled by a single control circuit, and a zener diode that limits the voltage across the two output leads and protects the circuit from damage if it is reverse connected.

The circuit sets the voltage level between the two output leads in a range between 1.7 and 12 volts to control the brightness of lights connected to the ballast. At 2 volts or below, lights are at their dimmest level, which is 20 percent of their maximum brightness, while at 10 volts or above, lights are set at the 100 percent level. Between 2 and 10 volts, the brightness of a light is set on a linear scale between 20 and 100 percent.

The control circuit allows a user to adjust the brightness level of the light or lights connected to the ballast at the sensor or at a remote location connected to the sensor by low-voltage wiring. The control circuit also allows a user to adjust the response time in which the circuit effects changes to the light level. Additionally, and of prime importance, the disclosed control circuit accomplishes all of this in an inexpensive manner when manufactured on a large scale.

In another embodiment of the present invention, the control circuit adjusts the controlled lights brighter at a first rate of change when the photosensor detects the level of ambient light has dropped. The circuit also adjusts the controlled lights dimmer at a second rate of change when the photosensor detects the ambient light level has increased.

Because peoples' eyes are relatively slow in adjusting to decreases in light, in still another embodiment of the present invention, the second rate of change is slower than the first rate of change. Thus, when the ambient light level goes down, the control circuit quickly changes the light level accordingly, while if the ambient light level increases, the lighting level is adjusted downward at a relatively slower rate.

In a another embodiment of the present invention, the control circuit allows a user to select the desired brightness level with an appropriate control. When changing the desired brightness level, the control circuit changes the intensity of the lights at a third rate of change which is quicker than either the first or second rates.

DESCRIPTION OF THE PREFERRED EMBODIMENT

Figure 1:
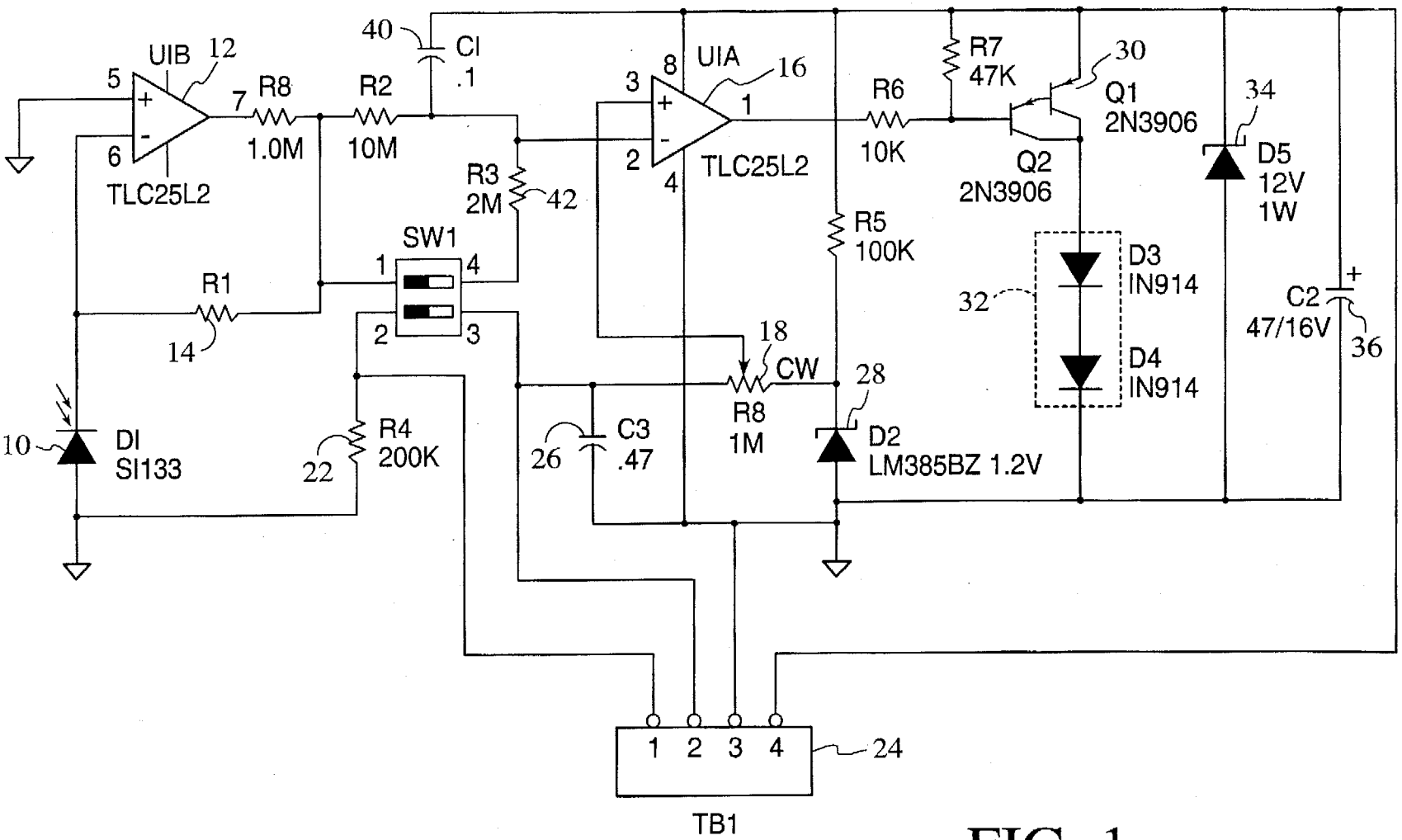
FIG. 1 is a detailed schematic diagram of the dimmable ballast control circuit according to the present invention.

FIG. 1 is a detailed schematic diagram of the dimmable ballast control circuit according to the present invention. In FIG. 1, a photo sensor 10 detects the light level in a room through a lens which is not shown. The lens is set so that the field of view for the sensor is about 45 degrees. Thus, if the lens is mounted on an 8-foot-high ceiling, photo sensor 10 will detect light within a cone having a diameter of a little more than 6.5 feet at the floor. Light outside of this cone will not be detected by the photosensor. In one embodiment, the lens can be moved closer to and further from photo sensor 10 to increase and decrease the sensor's field of view.

The output of photo sensor 10 is coupled to the summing junction of an operational amplifier 12, which has its reference junction coupled to a ground potential. The gain of operational amplifier 12 is set by a resistor 14, coupled between the negative input and output of operational amplifier 12. Using operational amplifier 12, with its reference junction zero biased, to amplify the output of photo sensor 10 results in a linear output of amplifier 12 in response to the detected light level.

The amplified detected light level is output from operational amplifier 12 to the summing junction of operational amplifier 16. To minimize costs, the preferred embodiment uses a single chip (TLC25L2 manufactured by Texas Instruments) having dual low-voltage CMOS operational amplifiers which can operate on as little as 1.4 volts of energy to implement operational amplifier 12 and operational amplifier 16. The reference junction of operational amplifier 16 is coupled to the wiper of a potentiometer 18. Thus, operational amplifier 16 outputs the difference between the reference voltage set at its reference junction and the signal output from operational amplifier 12.

Potentiometer 18 controls the brightness range in which the dimmable ballast can operate lights connected to it by adjusting the voltage at the reference junction of operational amplifier 16. When potentiometer 18 is set to its maximum level, the voltage at the reference junction is at its lowest level and the controlled light can be adjusted anywhere from 20 to 100 percent output. When potentiometer 18 is set to minimum resistance, the voltage level at the reference junction is at its greatest level and the intensity of the controlled light can only be adjusted along a small range.

A switch 20 allows for a remote potentiometer to control the range at which the Mark VII ballast can set a light. Switch 20 comprises two separate switches, one of which couples potentiometer 18 to a ground potential through a resistor 22 or to a remote potentiometer, not shown, through input pins 1 and 2 of a cable connector 24. Of course, a person skilled in the art will recognize other methods of implementing switch 20. For example, either a jumper or simply cutting the connecting wire and twisting it back together can be used to function as each separate switch in switch 20.

The remote potentiometer is coupled to pins 1 and 2 of a cable connector 24 by low voltage wiring. In order for the remote potentiometer to maximize its control of the light, potentiometer 18 should be set to its minimum level. If potentiometer 18 is set to the 50 percent level, the remote potentiometer can only control approximately 50 percent of the light's output range, and if potentiometer 18 is set to its maximum level, the remote potentiometer will have almost no effect on the circuit. Capacitor 26 limits noise on the line connecting the remote potentiometer.

Current from the dimmable ballast is supplied to the control circuit through pins 3 and 4 of cable connector 24. Pin 3 is coupled directly to a ground potential, and the potential at pin 4 is proportional to the gain of operational amplifier 16. Thus, the potential between pins 3 and 4 is set by the control circuit to control the brightness of lights connected to the dimmable ballast. Additionally, operational amplifiers 12 and 16 derive their power from the voltage potential between pins 3 and 4, making the signal terminals and the supply terminals of the control circuit of the present invention one and the same.

Reference diode 28 is coupled to potentiometer 18 and, depending on the setting of potentiometer 18, sets the voltage at the reference junction of operational amplifier 16 from between 1.2 volts to 0.2 volts. The output of operational amplifier 16 is coupled to the base of a Darlington PNP transistor 30. Darlington transistor 30 amplifies the output so that up to 100 ballasts can be controlled by the control circuit. Of course, persons skilled in the art will readily recognize that various other amplification devices such as a single transistor or operational amplifier may be used in place of Darlington transistor 30.

The emitter of Darlington transistor 30 is coupled to pin 4 of connector 24, and the collector is coupled to a pair of diodes 32. Diodes 32 ensure that the potential between pins 3 and 4 does not drop below 1.7 volts, and thus ensure that operational amplifiers 12 and 16 always have a large enough power supply to operate correctly.

Also directly coupled between pins 3 and 4 are a zener diode 34 and a large capacitor 36. Zener diode 34 is a 12-volt zener which ensures that the voltage between pins 3 and 4 does not increase above 12 volts and prevents damage to the circuit if it is reverse connected. Capacitor 36 reduces noise between the pins.

The time it takes the control circuit to respond to changes in the detected light level is determined by the RC constant of operational amplifier 16. When the second switch of switch 20 is open, the RC constant is set by a resistor 38 and a capacitor 40. In one embodiment, resistor 38 is a 10 million ohm resistor while capacitor 40 is a 0.1 farad capacitor. These values provide a response time of about 10 seconds. Thus, it takes the control circuit about 10 seconds to brighten the lights when photo sensor 10 detects less ambient light in its field of view. This ensures that the control circuit will not adjust the lighting of the Mark VII ballast if the photo sensor is temporarily blocked by an object.

A second switch of switch 20 is used to reduce the RC constant by closing the switch to couple a resistor 42 (2 million ohms) in parallel with resistor 38, thus making the circuit react quicker to light changes. When the second switch of switch 20 is closed, the circuit has a response time of about 2 seconds. Of course, a person skilled in the art will recognize that additional resistors can be switched in and out to provide more than two response times to select from, or that changing the capacitance of the circuit, rather than the resistance, can be done to change the time constant. Additionally, rather than switch resistor 42 in and out of the circuit, it is possible to hard-wire resistor 42 in and out the wire to switch it out of the circuit or use pins and a jumper connector.

Figure 2:
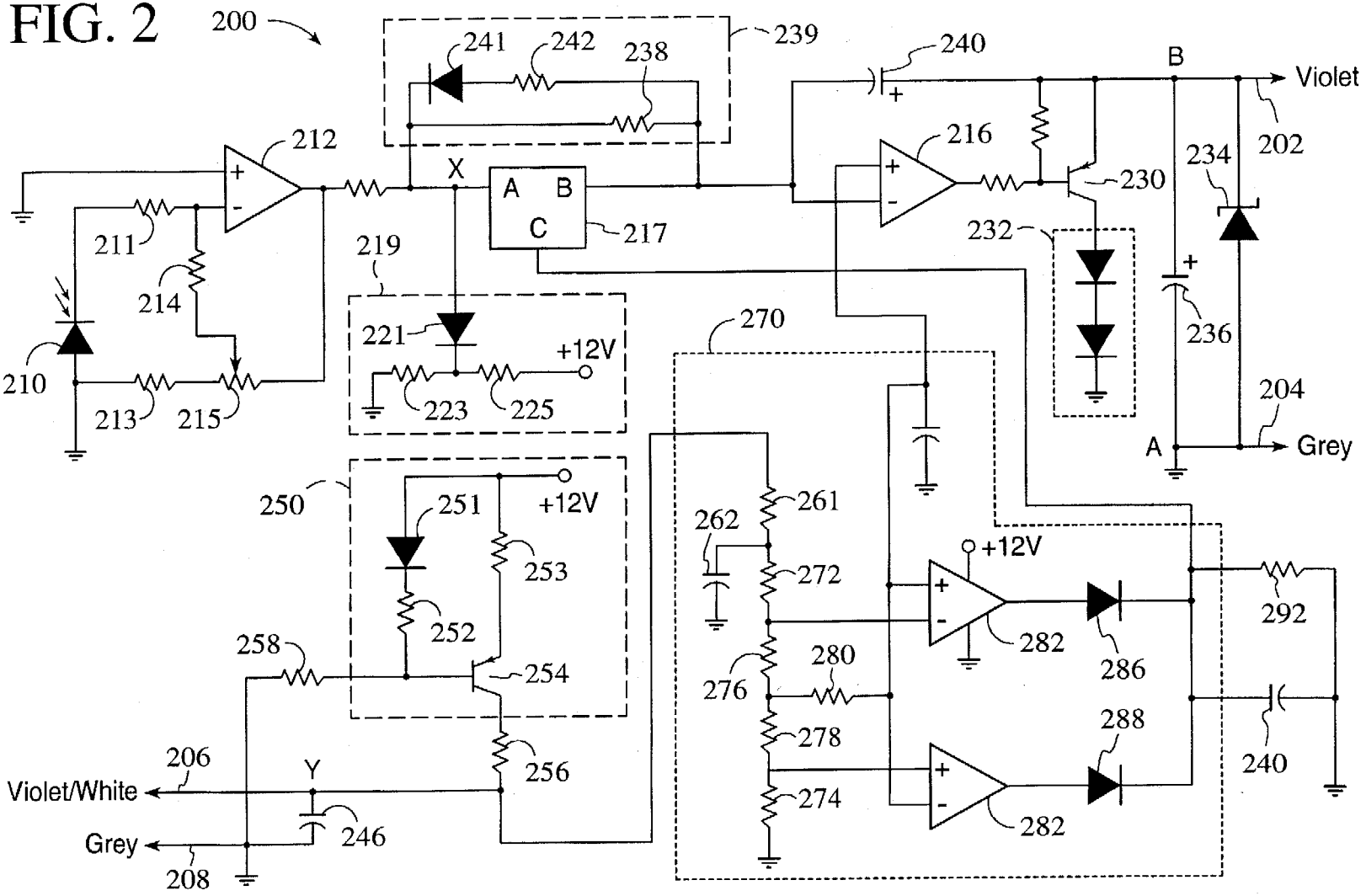
FIG. 2 is a detailed schematic diagram of a second embodiment of the dimmable ballast control circuit according to the present invention.

FIG. 2 is a detailed schematic diagram of a second embodiment of dimmable ballast control circuit (circuit 200) according to the present invention. In FIG. 2, a photosensor 210 detects the light level in a room through a lens which is not shown. The lens is set so that the field of view for the sensor is about 60 degrees. Similar to the embodiment of FIG. 1, the lens can be moved closer to and further from photo sensor 210 to increase and decrease the sensor's field-of-view.

The output of photo sensor 210 is coupled to a resistor 211 which is coupled to the summing junction of an operational amplifier 212. The reference junction of operational amplifier 212 is coupled to a ground potential, and the gain of amplifier 212 is set and controlled by resistors 213 and 214 and potentiometer 215 in a manner well-known to those skilled in the art.

The amplified detected light level is output from operational amplifier 212 to the summing junction of operational amplifier 216 through CMOS switch 217, resistor 238, and diode 241 and resistor 242. Resistor 238, diode 241, and resistor 242 make up an integrating circuit 239 that is coupled in parallel with CMOS switch 217 between the output of amplifier 212 and the input of amplifier 216. A capacitor 240 is also coupled to the summing junction input of amplifier 216.

A voltage clamp 219 protects the voltage at node X (a point coupled to the input of CMOS switch 217, a terminal of resistor 238, and the anode of diode 241) from rising above 5.2 volts. Voltage clamp 219 consists of a diode 221 and resistors 223 and 225. Resistors 223 and 225 form a voltage divider coupled between a 12-volt voltage source and a ground reference. Diode 221 is coupled between the resistors and conducts current to ground when the voltage potential at node X rises above 5.2 volts.

Current from the dimmable ballast is supplied to the control circuit of FIG. 2 through wires 202 and 204. Wire 204 is coupled directly to a ground potential at node A, and the potential on wire 202 at a node B is proportional to the gain of operational amplifier 216. Thus, the potential between nodes A and B is set by the control circuit to control the brightness of lights connected to the dimmable ballast. Additionally, as in the circuit of FIG. 1, operational amplifiers 212 and 216 derive their power from the voltage potential between nodes A and B, making the signal terminals and the supply terminal of the control circuit the same.

Coupled directly between nodes A and B is a transistor 230 and a pair of diodes 232. Transistor 230 amplifies the output of amplifier 216 so that up to 100 ballast can be controlled by the control circuit. Diodes 32 ensure the potential between nodes A and B does not drop below 1.7 volts so that amplifiers 212 and 216 always have a large enough power supply to operate correctly.

Also coupled between nodes A and B are a zener diode 234 and a capacitor 236. Zener diode 234 is a 12-volt zener which ensures that the voltage between nodes A and B does not increase above 12 volts and prevents damage to the circuit if it is reverse connected. Capacitor 236 reduces noise between the nodes.

A pair of wires 206 and 208 connects a portion of the circuit to a wall control unit such as a potentiometer, not shown. The wall control unit can be a slidable switch or similar device as is well known to those of ordinary skill in the art. Because wires 206 and 208 can be long and may be unshielded, a capacitor 246 is connected between the wires to remove noise. Also connected to wires 206 and 208 is a current source 250 that includes a diode 251, resistors 252 and 253, and a PNP transistor 254. Current source 250 is coupled to a 12 volt voltage source, wire 206 through a resistor 256, and wire 208 through a resistor 258.

A filter 260 is also coupled to wire 206. Filter 260 includes a resistor 261 and a capacitor 262 coupled to a ground reference. Coupled to filter 260 is a window comparator 270. Window comparator 270 includes resistors 272, 274, 276, 278, and 280; comparators 282 and 284; diodes 286 and 288; and a capacitor 290. Resistor 272 is coupled at one terminal to filter 260 and at a second terminal to a first terminal of resistor 276 and the inverting input of comparator 282. A second terminal of resistor 276 is coupled to a first terminal of resistor 278 and to a first terminal of resistor 280. A second terminal of resistor 278 is coupled to a first terminal of resistor 274 and to the noninverting input of comparator 284. A second terminal of resistor 274 is coupled to a ground reference level.

The noninverting input of comparator 282 is coupled to a second terminal of resistor 280 and the inverting input of comparator 284. The output of comparator 282 is coupled to the anode of diode 286, and the output of comparator 284 is coupled to the anode of diode 288. The cathodes of diodes 286 and 288 are coupled to a control input of CMOS switch 217, a capacitor 290, and a resistor 292.

Resistors 272 and 274 provide a voltage divider that divides the voltage between node Y (on wire 206) and ground in half. The first half of the voltage level is input to the inverting input of comparator 282, while the second half is input to the noninverting input of comparator 284. Resistors 276 and 278 are much smaller (4.7K ohms) than resistors 272 and 274 (100K ohms) and thus do not have much effect on the divided voltage level. Instead, as well known to those skilled in the art, resistors 276 and 278 create a voltage window so that slight changes or variations in the voltage level between wires 206 and 208 do not effect the lighting level as set by the light control circuit.

In operation of control circuit 200, CMOS switch 217 is normally open. Thus, the time it takes the circuit to respond to changes in the detected light level is determined by the RC constant of operational amplifier 216, which, for the most part, is set by integrating circuit 239 and capacitor 240. When circuit 200 increases the brightness of a light, current flows through diode 241, resistor 242, and resistor 238. Thus, the time constant is smaller than when a light's brightness is decreased and the brightness of the controlled light is increased relatively quickly.

Figure 3:
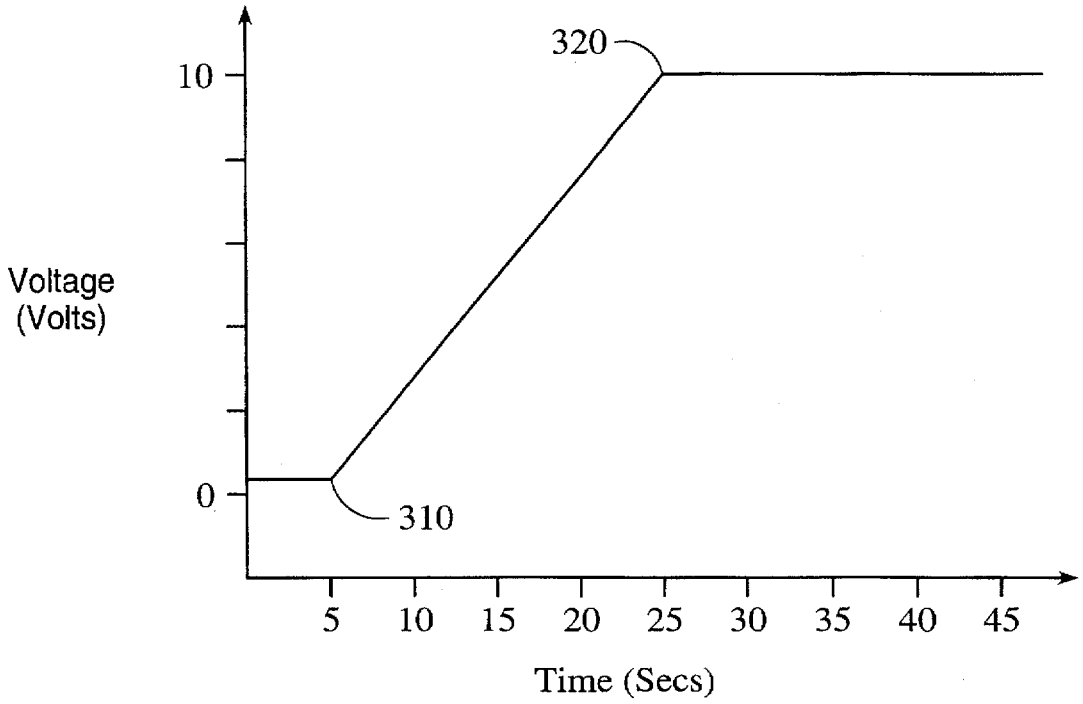
FIG. 3 is a voltage level graph showing the rate at which one embodiment of the ballast control circuit depicted in FIG. 2 increases a light's intensity in response to an decrease in ambient light.

FIG. 3 is a voltage level graph showing the rate at which one embodiment of ballast control circuit 200 depicted in FIG. 2 increases a light's intensity in response to an decrease in ambient light. In FIG. 3, control circuit 200 detects that the lighting in a room should be adjusted brighter at point 310. Circuit 200 then increases the lighting level by changing the voltage level supplied to the dimmable ballast at a rate of approximately 0.5 volts per second. Thus, circuit 200 increases the brightness of a light from its minimum level to its maximum level (point 320) in approximately 20 seconds.

When control circuit 200 decreases the brightness of a controlled light, diode 241 blocks current flow through resistor 242 so that the time constant of the circuit is primarily set by resistor 238 and capacitor 240. In this case, the larger time constant results in the light level being decreased at a relatively slow rate of change.

Figure 4:
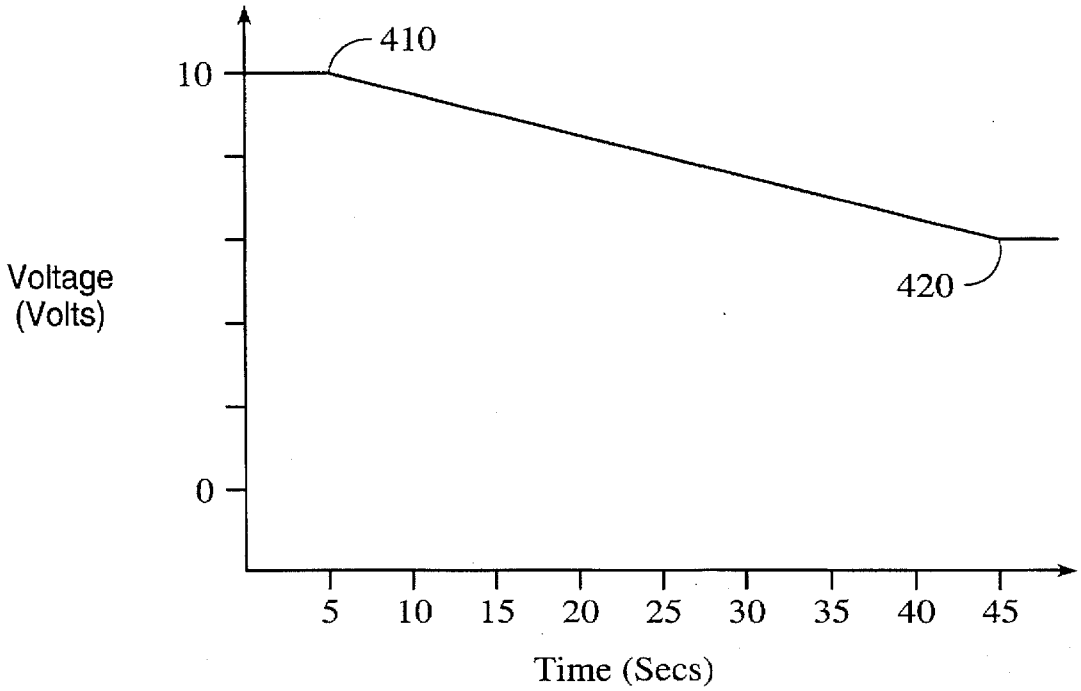
FIG. 4 is a voltage level graph showing the rate at which one embodiment of the ballast control circuit depicted in FIG. 2 decreases a light's intensity in response to an increase in ambient light.

FIG. 4 is a voltage level graph showing the rate at which one embodiment of the ballast control circuit depicted in FIG. 2 decreases a light's intensity in response to an increase in ambient light. In FIG. 4, control circuit 200 detects that the lighting in a room should be decreased at point 410. Circuit 200 then increases the lighting level by changing the voltage level supplied to the dimmable ballast at a rate of approximately 0.1 volts per second. Thus, circuit 200 decreases the brightness of a light from its maximum level to its minimum level in approximately 100 seconds. In FIG. 4, a control circuit 200 decreases the brightness of a light from a 10-volt signal to approximately a 6-volt signal (point 420) in about 40 seconds. Of course, the actual rate of increase and decrease can be changed as appropriate by selecting components that supply different time constants to circuit 200.

When the wall control unit between wires 206 and 208 is adjusted to increase or decrease the light level, circuit 200 changes the light's brightness at a third rate of change that seems almost instantaneous to the person adjusting the wall control unit. The quicker rate of change allows for precise control and selection of an appropriate lighting level.

When the wall control unit between wires 206 and 208 is adjusted to increase the brightness of the light, comparator 284 detects a voltage level change and outputs a positive signal through diode 288 to the control gate of CMOS switch 217. The positive signal both closes CMOS switch 217 and charges capacitor 290. With CMOS 217 closed, integrating circuit 239 is shorted out thus reducing the time constant of for changing the voltage potential between nodes A and B.

CMOS switch 217 stays closed for a duration controlled by time constant of capacitor 290 and resistor 292. In one embodiment, capacitor 290 and resistor 292 provide a time constant of 10 seconds. Thus, when the wall control unit is adjusted, there is a period of several seconds, depending on the voltage level required to flip the control gate of CMOS switch 217, where the brightness of lights coupled to the control circuit can be adjusted almost instantaneously. Once capacitor 290 discharged sufficiently, CMOS switch 217 opens again and the brightness of lights connected to the circuit is adjusted according to the time constant set in part by integrating circuit 239.

Similarly, when the wall control unit between wires 206 and 208 is adjusted to decrease the brightness of the light, comparator 282 detects a voltage level change and outputs a positive signal through diode 286 to the control gate of CMOS switch 217. Just as when the brightness of a light is increased by the wall control unit, the positive signal closes CMOS switch 217, thus reducing the time constant, and charges capacitor 290. Capacitor 290 keeps switch 217 closed for a predetermined time during which the brightness of lights coupled to the control circuit can be adjusted almost instantaneously.

Figure 5:
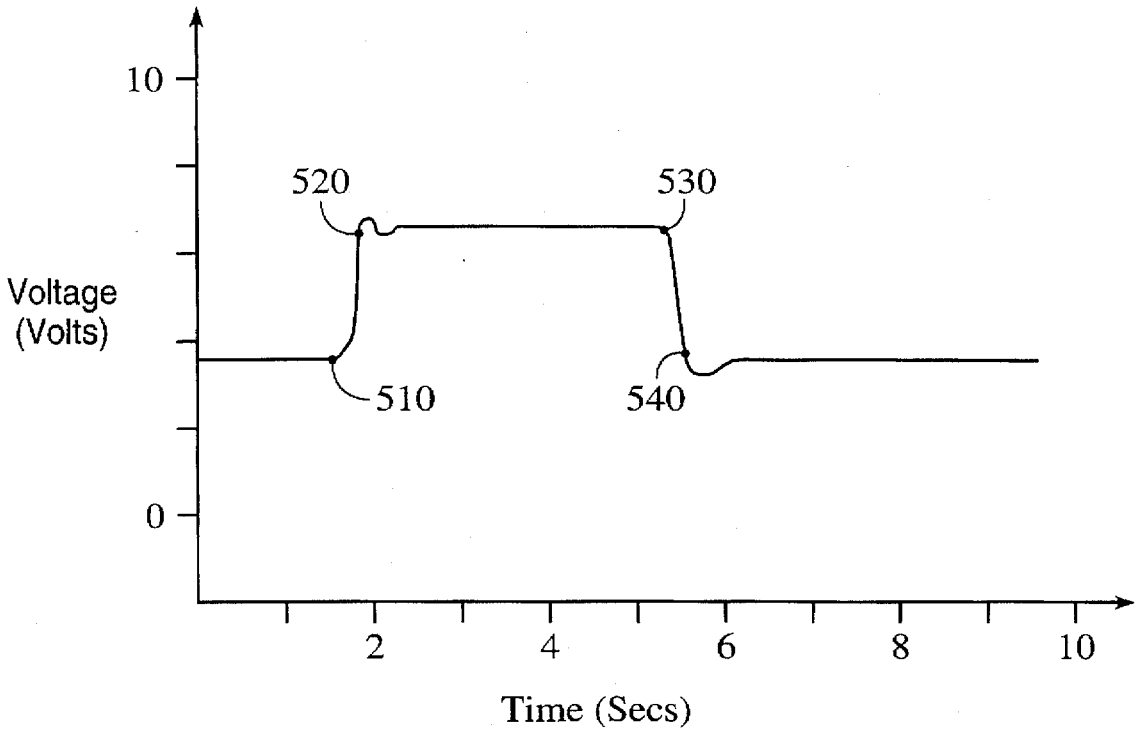
FIG. 5 is a voltage level graph showing the rate at which one embodiment of the ballast control circuit depicted in FIG. 2 increases and decreases a light's intensity in response to a user selecting a brightness level.

FIG. 5 is a voltage level graph showing the rate at which one embodiment of the ballast control circuit depicted in FIG. 2 increases and decreases a light's intensity in response to a user selecting a brightness level through a wall control unit. In FIG. 5, a user adjusts the wall control unit by sliding a control lever or the like at point 510 to increase the brightness of a light. After an initial delay on the order of less than 0.1 seconds, the voltage supplied to the light increases rapidly to point 520, the selected level. As shown, a change of approximately 3 volts takes less than 0.5 seconds (approximately 0.25 seconds). The light level is then decreased with the wall control unit from a level corresponding to approximately a 6.8 volt control signal at point 530 to a level corresponding to approximately a 3.8 volts control signal at point 540 also in substantially less than 0.5 seconds.

Thus, when the lighting level is changed in response to an adjustment to the wall control unit, circuit 200 changes the control voltage at a rate of approximately 6 volts per second—much quicker than when the light level is increased or decreased in response to the detected ambient light level. Of course, selecting different values for capacitor 290 and resistor 292 allows the light level to be changed faster or slower as desired.

Having fully described several embodiments of the present invention, many other equivalent or alternative methods of implementing the present sensor will be apparent to those skilled in the art. These equivalents and alternatives are intended to be included within the scope of the present invention.

What is claimed is:

1. A circuit for controlling the brightness level of a light coupled to a dimmable electronic ballast, said circuit comprising:

a photosensor for sensing an ambient light level;

an intensity setting circuit, coupled to said photosensor, for setting variable intensity level of the light in response to signals received from said photosensor, said intensity setting circuit increasing the intensity level of the light at a first rate of change and decreasing the intensity level of the light at a second rate of change, said intensity setting circuit including a first RC circuit which has a resistance and a capacitance, associated therewith, defining a variable time delay, with said variable time delay establishing said first rate to be faster than said second rate; and a control circuit, coupled to said intensity setting circuit to selectively reduce said resistance, thereby allowing the intensity level of the light to vary at a third rate and independent of the signals received from the photosensor.

2. The circuit set forth in claim 1 wherein said third rate is faster than said first rate.

3. The circuit set forth in claim 2 wherein said intensity setting circuit includes a diode coupled to said first RC circuit so as to be forward biased when the level of the light intensity increases and reversed biased when the level of the light intensity decreases.

4. The circuit set forth in claim 1 wherein said control circuit includes a second RC circuit to selectively reduce said resistance to zero for a predetermined interval of time.

5. A circuit for controlling the brightness of a light coupled to a dimmable electronic ballast, said circuit comprising:

a photodetector for sensing an ambient light level;

an intensity setting circuit, coupled to said photodetector, for setting variable intensity levels of the light in response to signals received from said photodetector, said intensity setting circuit being adapted to increase the intensity level of the light at a first rate of change and decrease the intensity level of the light at a second rate of change, with the intensity setting circuit including a first RC circuit and a diode, with the diode being coupled to said RC circuit to be forward biased when the level of the light intensity increases and reversed biased when the level of the light intensity decreases, thereby providing said RC circuit with a variable time delay fixing the first rate to be faster than the second rate;

a control circuit, coupled to said intensity setting circuit to selectively reduce said resistance, thereby allowing the intensity level of the light to vary at a third rate and independent of the signals receive from the photodetector, with said third rate being faster than said first rate.

6. A circuit for controlling the brightness of a light coupled to a dimmable electronic ballast, said circuit comprising:

a photodetector for sensing an ambient light level;

an intensity setting circuit, coupled to said photodetector, for setting variable intensity levels of the light in response to signals received from said photodetector, the intensity setting circuit increasing the intensity level of the light at a first rate of change and decreasing the intensity level of the light at a second rate of change, the intensity setting circuit including an RC circuit which has a resistance and a capacitance, associated therewith, defining a variable time delay, with said time delay establishing said first rate to be faster than said second rate; and a control circuit, coupled to said intensity setting circuit to selectively reduce said resistance to zero, thereby allowing the intensity level of the light to vary at a third rate and independent of the signals receive from the photodetector said control circuit comprising:

a window comparator; and a second RC circuit to selectively reduce the resistance to zero for a predetermined interval of time.

7. A circuit for controlling the brightness of a light coupled to a dimmable electronic ballast, said circuit comprising:

a photosensor for sensing an ambient light level;

an intensity setting circuit, coupled to said photosensor, for setting the intensity level of the light in response to said photosensor, said intensity setting circuit increasing the intensity level of the light at a first rate of change and decreasing the intensity level of the light at a second rate of change different than said first rate, said first rate of change being quicker than said second rate of change;

a control circuit that allows a user to select the brightness level of the light, wherein said control circuit changes, in response to a user's manual adjustment, the brightness of the light at a predetermined rate of change that is quicker than said first and second rates of change, said control circuit comprising a window comparator, said window comparator comprising a voltage divider that divides an input voltage into a plurality of voltage levels;

a first comparator, coupled to said voltage divider, for inputting a first voltage level of said plurality of voltage levels and for outputting a signal to increase the brightness of the light in response to a change in said first voltage level;

a first diode, coupled to an output of said first comparator;

a second comparator, coupled to said voltage divider, for inputting a second voltage level of said plurality of voltage levels and for outputting a signal to decrease the brightness of the light in response to a change in said second voltage level; and a second diode, coupled to an output of said second comparator and coupled to said first diode.

8. A circuit for controlling the brightness of a light coupled to a dimmable electronic ballast, said circuit comprising:

a photodetector for sensing an ambient light level;

an intensity setting circuit, coupled to said photodetector, for setting variable intensity levels of the light in response to signals received from said photodetector, said intensity setting circuit being adapted to increase the intensity level of the light at a first rate of change and decrease the intensity level of the light at a second rate of change, with the intensity setting circuit including a first RC circuit and a diode, with the diode being coupled to said RC circuit to be forward biased when the level of the light intensity increases and reversed biased when the level of the light intensity decreases, thereby providing said RC circuit with a variable time delay fixing the first rate to be faster than the second rate; and a control circuit coupled to said intensity setting circuit, said control circuit including a second RC circuit to selectively reduce said resistance to zero for a predetermined interval of time.

9. A circuit for controlling the brightness of a light coupled to a dimmable electronic ballast, said circuit comprising:

a photodetector for sensing an ambient light level;

an intensity setting circuit, coupled to said photodetector, for setting the intensity level of the light in response to said photodetector, said intensity setting circuit being adapted to set variable intensity levels of the light in response to signals received from said photodetector, the intensity setting circuit increasing the intensity level of the light at a first rate of change and decreasing the intensity level of the light at a second rate of change, the intensity setting circuit including an RC circuit which has a resistance and a capacitance, associated therewith, defining a variable time delay, with said time delay establishing said first rate to be faster than said second rate; and a control circuit, coupled to said intensity setting circuit, to selectively reduce said resistance to zero, thereby allowing the intensity level of the light to vary at third rate and independent of the signals receive from the photodetector, said control circuit including a second RC circuit to selectively reduce the resistance to zero for approximately ten seconds.

10. The circuit set forth in claim 5, wherein said control circuit selectively reduces said resistance to zero.

* * * * *